US006785983B2

(12) United States Patent
Challe

(10) Patent No.: US 6,785,983 B2
(45) Date of Patent: Sep. 7, 2004

(54) BOOT PROVIDED WITH A GAITER

(75) Inventor: Jean-Michel Challe, Rumilly (FR)

(73) Assignee: Salomon S.A., Metz-Tessy (FR)

( * ) Notice: Subject to any disclaimer, the term of this patent is extended or adjusted under 35 U.S.C. 154(b) by 19 days.

(21) Appl. No.: 10/293,297

(22) Filed: Nov. 14, 2002

(65) Prior Publication Data

US 2003/0093918 A1 May 22, 2003

(30) Foreign Application Priority Data

Nov. 21, 2001 (FR) ..... 01 15211

(51) Int. Cl.[7] ..... A41D 17/00
(52) U.S. Cl. ..... 36/2 R
(58) Field of Search ..... 36/1.5, 2 R

(56) References Cited

U.S. PATENT DOCUMENTS

| | | | | | |
|---|---|---|---|---|---|
| 1,844,997 | A | | 2/1932 | Weigle | |
| 2,054,958 | A | * | 9/1936 | Tousley | 36/1.5 |
| 2,398,802 | A | * | 4/1946 | Morris | 36/1.5 |
| 3,618,232 | A | * | 11/1971 | Shnuriwsky | 36/1.5 |
| 4,542,597 | A | | 9/1985 | Baptista et al. | 36/2 R |
| 4,856,207 | A | | 8/1989 | Datson | 36/2 R |
| 5,642,573 | A | * | 7/1997 | Brown | 36/2 R |
| 6,148,544 | A | | 11/2000 | Keen et al. | 36/1.5 R |
| 6,473,999 | B2 | | 11/2002 | Fellouhe | 36/50.1 |
| 2001/0025434 | A1 | | 10/2001 | Fellouhe | 36/50.1 |

FOREIGN PATENT DOCUMENTS

| | | | |
|---|---|---|---|
| FR | 2657755 | | 8/1991 |
| GB | 2170992 | * | 8/1986 |

* cited by examiner

*Primary Examiner*—Ted Kavanaugh
(74) *Attorney, Agent, or Firm*—Greenblum & Bernstein, P.L.C.

(57) ABSTRACT

A boot of the type having an upper equipped with a lacing zone, a tongue located under the lacing zone and a gaiter fixed to the upper edge of the upper. The gaiter is made of an extensible material, and it is fixed along the upper edge of the tongue of the upper. Advantageously, the tongue is equipped at its upper end with an extensible pocket for storing the lacing system.

21 Claims, 3 Drawing Sheets

23
24
26
25
20
1
21
19
11
10
18
30
14
13
16a
3
12
16
2
15

BOOT PROVIDED WITH A GAITER

CROSS-REFERENCE TO RELATED APPLICATIONS

This application is based upon French Patent Application No. 01.15211, filed Nov. 21, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a boot equipped with a gaiter in order to provide protection against the penetration of sand, pebbles, and various objects.

2. Description of Background and Relevant Information

It is known to equip boots with gaiters for protection against the cold or for impermeability. A traditional solution is to wear gaiters that are separate from the boot, i.e., that are removable, that more or less cover the upper portion of the boot and at least partially surround the wearer's lower leg.

Another proposed solution is to attach a flexible gaiter externally to the rear of the boot upper, for example, by means of a stitched seam that, if necessary, is shielded in a pocket provided for this purpose on the rear of the upper when it is not in use.

It is known from U.S. Pat. No. 6,148,544 to equip a low upper shoe with a water-proof gaiter, tubular in shape, sewn along the upper edge of this upper and extending along the lacing zone by replacing the traditional tongue.

This construction imparts good impermeability to the boot against water, and avoids having to make a separate tongue. Nevertheless, it is not as comfortable. In addition, the impermeable material constituting the gaiter is non-extensible, such that the gaiter has a tubular shape wide enough to allow positioning the foot inside of the boot and, therefore, it must be provided at its upper end with a cord and clamp tightening system. Such non-elastic closure systems, however, are not very efficient for avoiding the penetration of small pebbles and sand inside of the boot.

SUMMARY OF THE INVENTION

The present invention is provided for overcoming the aforementioned drawbacks and to provide a boot equipped with a gaiter that is completely impermeable to any penetration of pebbles, sand, etc., and that can be used particularly as a running shoe in aggressive, natural environments.

The boot according to the invention includes an upper equipped with a lacing zone and a gaiter fixed to the upper edge of the upper. The gaiter is made of an extensible material and is fixed along the upper edge of the tongue of the upper.

BRIEF DESCRIPTION OF DRAWINGS

The invention will be better understood and other characteristics thereof will become apparent from the following description, with reference to the attached schematic drawings, and in which.

DETAILED DESCRIPTION OF THE INVENTION

Figure 1:
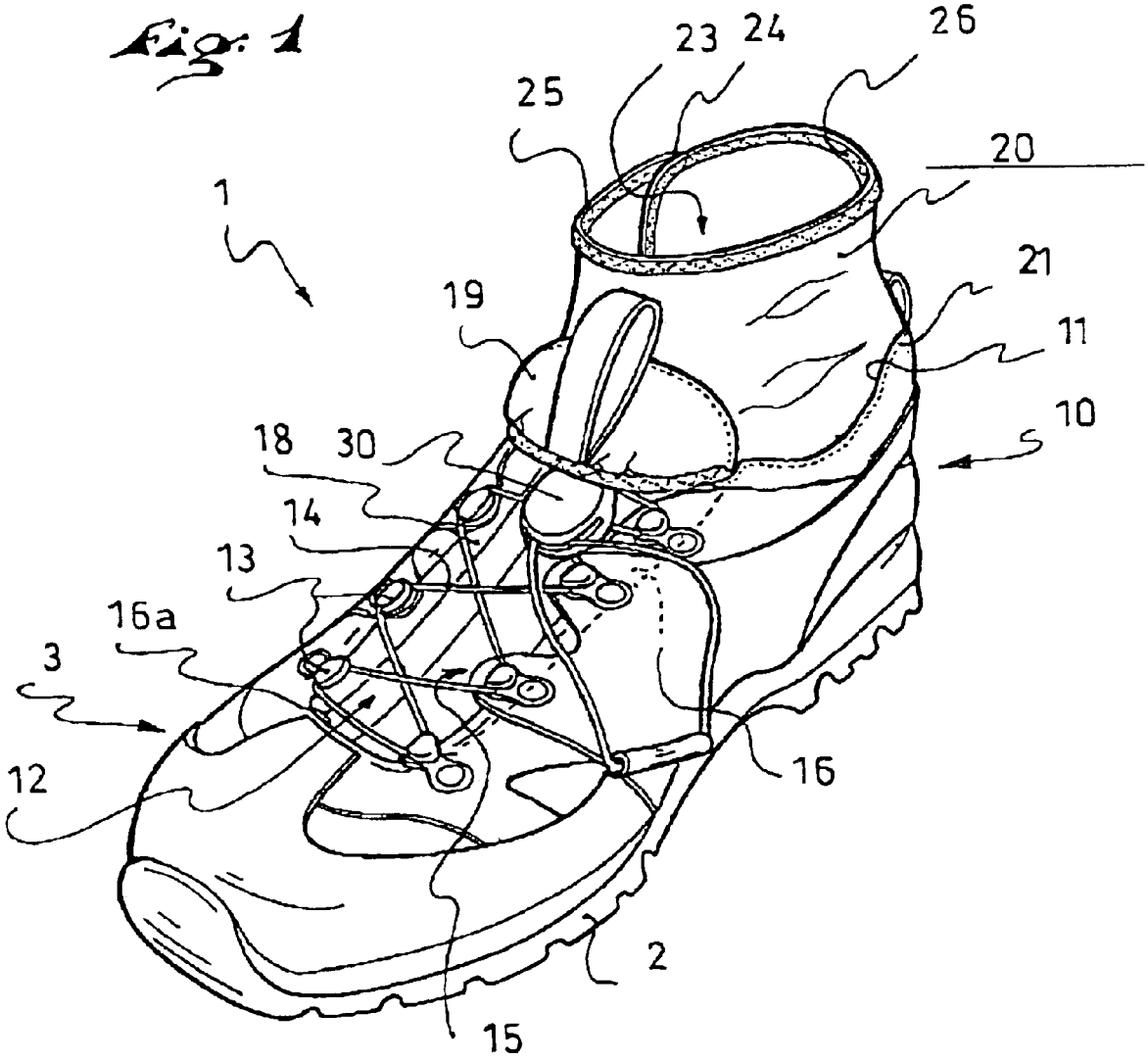
FIG. 1 is a perspective view of a boot according to the invention.
Figure 2:
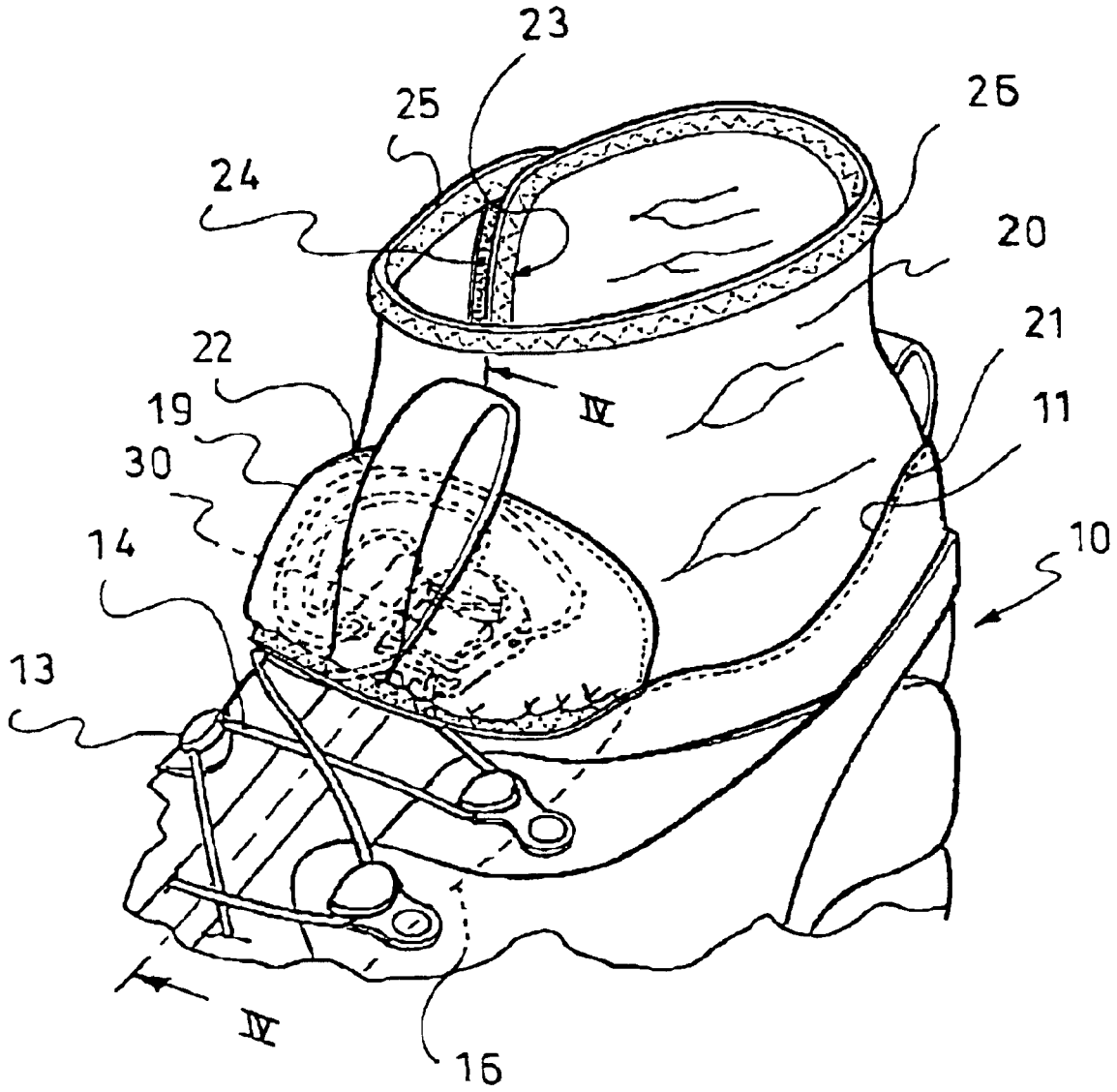
FIG. 2 is, on an enlarged scale, a detailed view of FIG. 1.

As seen more particularly in FIG. 1, the boot 1 according to the invention is composed of an upper 10, fixed to a sole 2 and equipped with a gaiter 20.

In this embodiment, the upper 10 is a low upper, but the invention encompasses a boot having a high or semi-high upper. The upper 10 has an upper edge 11 adapted to allow the user to insert his/her foot, and a lacing zone 12 extending substantially along the longitudinal direction of the boot on the top of the upper, between the front end 3 of the boot and the upper edge 11 thereof.

The lacing zone 12 is equipped with keepers/guides 13 arranged along the opening 15 and receiving/guiding a lace 14 or the like for tightening the boot on the foot. Under the lacing zone 12 is arranged, in a known manner, a tongue 16 adapted to distribute the pressure originating from the tightening and to provide the comfort necessary to the user's foot. This tongue 16 is fixed at its front end 16*a* to the front end of the lacing zone 12.

Furthermore, between the tongue 16 and the upper 10 is fixed a gusset 18 made of an elastic material that completely closes the opening of the lacing zone 12 and thus prevents any ill-timed penetration of pebbles, sand, or debris inside of the boot.

Other means and/or structures for sealing against outside elements can be provided, such as gussets that laterally connect the tongue 16 to the upper.

The construction with an elastic gusset 18 is preferred for very "rough" applications, i.e., in very aggressive environments, since it does prevent, in combination with the gaiter 20, any penetration of foreign bodies inside of the boot.

In the present case, the gusset 18 is arranged under the keepers 13 and lace 14, but it could also be provided on the top. The gaiter 20 is constituted of an extensible material, i.e., an elastic material, such as LYCRA, along both directions.

Figure 3:
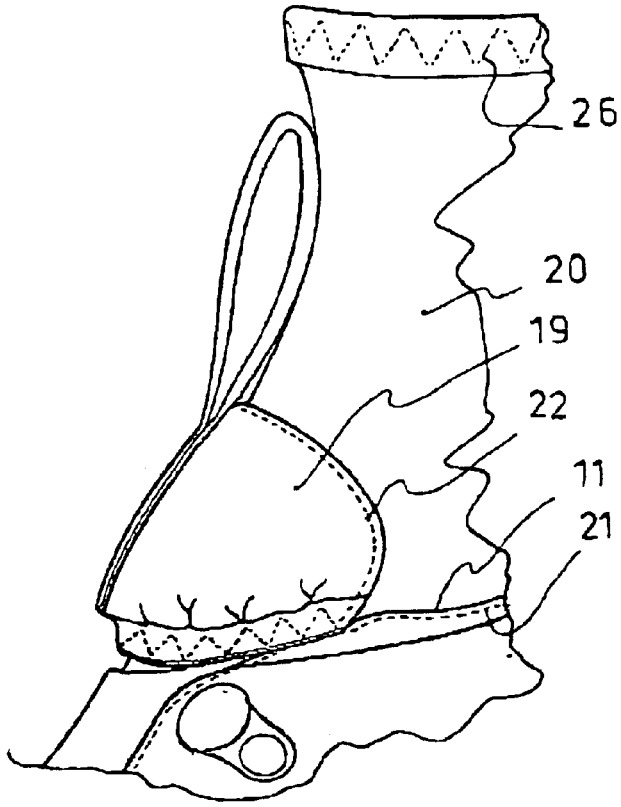
FIG. 3 is a partial side view of FIG. 2.
Figure 4:
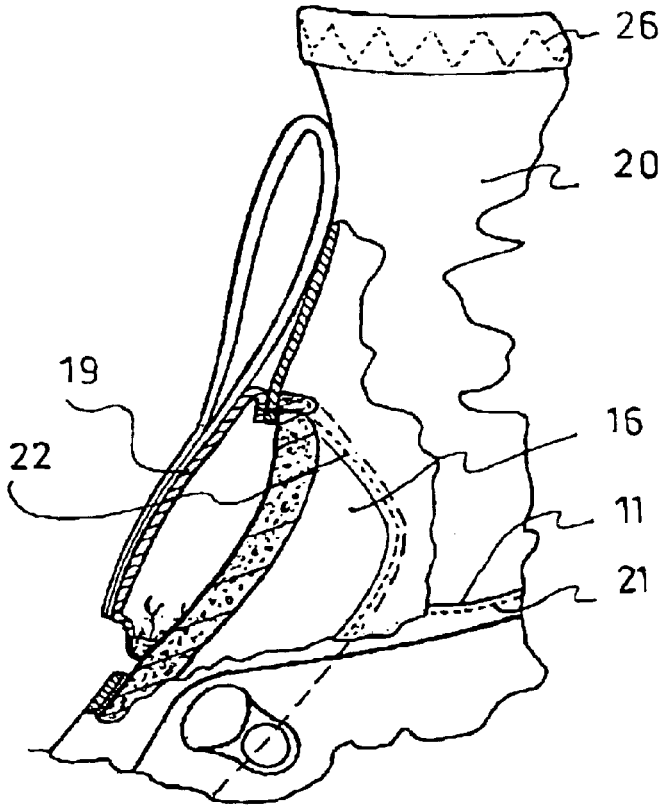
FIG. 4 is a cross-sectional view along the line IV—IV of FIG. 2.

As shown more particularly in FIGS. 3 and 4, the gaiter 20 is fixed along the upper edge of the upper 11 permanently by means of a seam or stitching 21, and permanently along the upper edge of the tongue 16 by means of a seam or stitching 22. These seams or stitchings 21, 22 can be simple seams as shown, or they can be turned under for a more pleasing effect.

The gaiter 20 is preferably fixed to the inside of the upper, so as to be as close to the user's ankle as possible and to thus provide proprioceptive sensations in addition to the function of impermeability. Furthermore, the gaiter is equipped with an opening 23 that is substantially vertical from the upper edge 11 of the upper, up to the upper edge 25 of the gaiter, so as to facilitate the positioning of the foot inside of the boot.

Depending on the extensibility of the material selected for the gaiter, this opening 23 could be omitted. However, to obtain the feature of having the gaiter 20 very close to the user's ankle, the opening 23 is provided. It is also contemplated to be within the scope of the invention to have the opening 23 arranged differently, for example, in an oblique manner for an adaptation to the foot and an optimal closure. For the purpose of closing the opening 23, a self-gripping device, i.e., such as hook and loop fasteners, can be equipped on the edges of the opening.

Other closure means and/or structures can also be provided within the scope of the invention.

The gaiter 20 has a substantially tubular shape, the volume of which corresponds substantially to the volume of the ankle that is to be received. Its shape is also provided to be as close to the ankle as possible.

In any event, the upper edge 25 of the gaiter is designed so as to have a perimeter that is less than that of the ankle that is to be received, and it is equipped with a band 26 made of rubber or other elastic material to guarantee a complete impermeability of the gaiter against the penetration of an outside object According to a preferred embodiment, the tongue 16 is equipped at its upper end with a pocket 19 made of an elastic material adapted to receive and house the end of the lacing 14. In the case where a clamp 30 is associated with the lace 14, the pocket 19 will have a sufficient volume and/or deformability in order to also house the associated clamp 30.

The boot according to the invention thus obtained therefore has all of the guarantees for resisting the penetration of foreign objects and storing the laces, and it can be used in races on very uneven and mountainous terrain, such as adventure racing.

The invention is not limited to the previously described particular embodiments, which are described as non-limiting examples, but it encompasses all similar or equivalent embodiments.

What is claimed is:

1. A boot comprising:

an upper including:

an upper edge;

a lacing zone including a plurality of lace guides mounted upon each of transversely opposed upper portions for guiding a lace within the lacing zone;

a tongue located under the lacing zone and under the upper portions, the tongue having an upper edge;

a gaiter fixed permanently to the upper edge of the upper, the gaiter being made of an extensible material, and fixed permanently along the upper edge of the tongue of the upper.

2. A boot according to claim 1, wherein the gaiter has an upper edge equipped with a band made of an elastic material.

3. A boot according to claim 1, wherein the transversely opposed upper portions are spaced apart by at least a predetermined distance in both tightened and untightened conditions of the boot, and wherein the gaiter is stitched transversely along the upper edge of the tongue at least said predetermined distance.

4. A boot according to claim 1, further comprising a lacing system and an extensible pocket equipped at the upper end of the tongue for storing the lacing system.

5. A boot according to claim 4, wherein the gaiter has an upper edge equipped with a band made of an elastic material.

6. A boot according to claim 1, wherein the gaiter is made of an elastic material.

7. A boot according to claim 6, wherein the gaiter has an upper edge equipped with a band made of an elastic material.

8. A boot according to claim 6, wherein the elastic material of the gaiter is directly affixed to the upper end of the upper.

9. A boot according to claim 6, wherein the gaiter comprises a vertical opening equipped with a self-gripping closing device.

10. A boot according to claim 9, wherein the gaiter has an upper edge equipped with a band made of an elastic material.

11. A boot according to claim 4, wherein the gaiter is made of an elastic material.

12. A boot according to claim 11, wherein the gaiter has an upper edge equipped with a band made of an elastic material.

13. A boot according to claim 1, wherein the gaiter comprises a vertical opening equipped with a self-gripping closing device.

14. A boot according to claim 13, wherein the gaiter has an upper edge equipped with a band made of an elastic material.

15. A boot according to claim 4, wherein the gaiter comprises a vertical opening equipped with a self-gripping closing device.

16. A boot according to claim 15, wherein the gaiter has an upper edge equipped with a band made of an elastic material.

17. A boot according to claim 11, wherein the gaiter comprises a vertical opening equipped with a self-gripping closing device.

18. A boot according to claim 17, wherein the gaiter has an upper edge equipped with a band made of an elastic material.

19. An article of footwear comprising:

an upper including:

an upper edge;

a lacing zone comprising a plurality of lace guides;

a tongue located under said lacing zone, the tongue having a transversely extending upper edge;

a gaiter comprising an elastic material, said gaiter being stitched to the upper edge of the upper and said elastic material of the gaiter extending upwardly from above the upper edge of the upper so as to be adapted to extend around a wearer's lower leg, said gaiter being stitched to the upper edge of the tongue of the upper.

20. An article of footwear according to claim 19, wherein:

said gaiter is stitched to the upper edge of the tongue above an upper end of said lacing zone.

21. An article of footwear according to claim 19, wherein:

said tongue is positioned beneath at least portions of the plurality of lace guides.

* * * * *